US005996647A

United States Patent [19]

Krumm

[11] Patent Number: 5,996,647

[45] Date of Patent: Dec. 7, 1999

[54] METHOD AND APPARATUS FOR FORMING A FABRIC LIST AND A CATCH SELVAGE WHILE WEAVING A WEB ON A LOOM

[75] Inventor: Valentin Krumm, Hergensweiler, Germany

[73] Assignee: Lindauer Dornier Gesellschaft GmbH, Lindau, Germany

[21] Appl. No.: 09/078,338

[22] Filed: May 13, 1998

[30] Foreign Application Priority Data

May 16, 1997 [DE] Germany ..... 197 20 634

[51] Int. Cl.[6] ..... D03C 47/08; D03D 47/40

[52] U.S. Cl. ..... 139/54

[58] Field of Search ..... 139/54, 50

[56] References Cited

U.S. PATENT DOCUMENTS

| | | | |
|---|---|---|---|
| 3,847,188 | 11/1974 | Auer et al. | 139/54 |
| 3,952,778 | 4/1976 | VOlpe . | |
| 4,166,480 | 9/1979 | Muller | 139/54 |
| 4,365,652 | 12/1982 | Koch et al. | 139/54 |
| 4,412,562 | 11/1983 | Kobayashi et al. . | |
| 4,421,141 | 12/1983 | Brouwer . | |
| 5,353,845 | 10/1994 | Corain et al. . | |
| 5,392,819 | 2/1995 | Lin . | |
| 5,518,039 | 5/1996 | Haeussler et al. . | |
| 5,524,678 | 6/1996 | Haeussler et al. . | |

FOREIGN PATENT DOCUMENTS 836475 4/1952 Germany .

*Primary Examiner*—Andy Falik
*Attorney, Agent, or Firm*—W. F. Fasse; W. G. Fasse

[57] ABSTRACT

In a method and an apparatus for producing a woven web (1) having a permanent fabric list (2) and a temporary catch selvage (3) along edges of the woven web (1), the weft thread is inserted into a main loom shed, fabric list shed, and catch selvage shed, and is then beat-up and bound-in in each shed. Both the fabric list (2) and the catch selvage (3) are formed as full rotation leno bindings, respectively by means of a first rotational leno device (12) having a first leno rotor (12A) guiding and manipulating fabric list threads (7) and a second rotational leno device (13) having a second leno rotor (13A) guiding and manipulating catch selvage threads (9). Each leno device (12, 13) may operate with or without reversal of the rotation direction. The two leno devices may be independently driven by separate rotary drives, or may be mutually driven by a common drive. The leno devices may be operated to bind-in the weft threads with the same or different binding patterns, relative to each other and relative to the main shed of warp threads. In this manner, a compact arrangement is achieved, the amount of thread needed for the catch selvage strip and for weft threads is reduced, the full advantages of the rotational leno devices can be obtained, and the loom can operate at its full speed.

46 Claims, 5 Drawing Sheets

METHOD AND APPARATUS FOR FORMING A FABRIC LIST AND A CATCH SELVAGE WHILE WEAVING A WEB ON A LOOM

PRIORITY CLAIM

This application is based on and claims the priority under 35 U.S.C. §119 of German Patent Application 197 20 634.4, filed on May 16, 1997. The entire disclosure of German Patent Application 197 20 634.4 is incorporated herein by reference.

FIELD OF THE INVENTION

The invention relates to a method and an apparatus for producing a woven web having a respective fabric list or permanent primary selvage along each side edge of the woven web, as well as a temporary secondary selvage or catch selvage strip, while the web is woven on a loom.

BACKGROUND INFORMATION

It is generally known to form or provide a primary selvage or fabric list along the edge of a woven web, as well as a temporary catch selvage outwardly alongside the fabric list, for different purposes. The fabric list or primary selvage remains a part of the finished woven fabric, while the secondary or catch selvage is used only temporarily during the weaving process and is then cut away from the woven web.

More specifically, in order to produce a high quality fabric having a durable fabric edge that resists unravelling and the like, it is known to bind or tie in the free ends of the weft threads along the edges of the woven web using so-called leno threads to achieve a full leno binding for forming a fabric list. Specialized rotational leno selvage forming devices have been developed for carrying out such full leno binding. German Patent 4,405,776 and corresponding U.S. Pat. No. 5,518,039 (Haeussler et al.), as well as German patent 4,405,777 and corresponding U.S. Pat. No. 5,524,678 (Haeussler et al.) disclose two different leno selvage forming devices that are capable of producing fabric list edges of the required quality and that are especially suitable for use with high speed looms, i.e. looms that carry out a very high weft insertion rate. The entire disclosure of each of the U.S. Pat. Nos. 5,518,039 and 5,524,678 is incorporated herein by reference.

The fabric list or permanent primary selvage is produced using so-called leno threads that bind in the weft threads on both edges of the woven web using known leno selvage forming devices. In high speed looms, it is especially suitable to use so-called reversible rotating leno selvage devices, which have reversibly rotatable leno disks or rotors that guide and manipulate the leno threads, such as the rotating leno selvage devices described in U.S. Pat. Nos. 5,518,039 and 5,524,678.

On the other hand, it has also been known to provide a secondary selvage or catch selvage strip for the following reason. While weaving a web on a loom, it is necessary to prevent a so-called spring-back of the free ends of a weft thread in a direction opposite the weft insertion direction, after the thread has been inserted and beat-up. Such spring-back of the inserted weft thread tends to occur due to the inherent elasticity of each inserted weft thread in the thread lengthwise direction. To prevent such thread spring-back, a so-called catch selvage strip is produced during the weaving process, in addition to and adjacent the above discussed fabric list or primary selvage, on both the weft insertion side and the weft arrival side of the loom shed. The purpose of the catch selvage strip is to securely bind in the free ends of the inserted weft threads to prevent the above mentioned spring-back during the weaving operation. After serving this temporary purpose, the catch selvage strip may be cut away from the woven web to produce the finished fabric.

In both air jet looms and mechanical gripper looms, the temporary catch selvage strip is conventionally formed using at least eight and up to twenty catch selvage threads, for firmly and securely binding in the respective ends of the weft threads. These catch selvage threads are stored and supplied wound up on catch selvage spools or bobbins, which therefore must be adapted to store at least eight and up to twenty catch selvage threads. By using this number of catch selvage threads, a relatively wide and thus material intensive catch selvage strip is produced.

It is also known to form the required catch selvage strip using a conventional multi-thread cross leno device, such as a so-called called four thread cross leno device. In this context, it is a disadvantage that the leno threads must be made of a material that is suitable for or adapted to withstand the mechanical loads placed on the threads in the cross leno device, for example due to significant thread deflections and the like. Thus, such leno threads must be made of a substantially break resistant material, for example a synthetic thread material. As a resultant disadvantage, the waste material arising from the trimmed catch selvage will not be composed of a single pure type of material, but rather will be a mixture of different materials. For example, the weft threads in the catch selvage strip typically comprise a natural material such as cotton or wool or the like, while the leno binding threads in the catch selvage strip are made of a synthetic material. It thus becomes difficult or impossible to reprocess or recycle the waste materials.

It is a further disadvantage, that the conventional multi-thread leno devices cannot keep up with a high loom operating speed, especially the high operating speeds that can be achieved by air jet looms. The operating speed of the loom and thus the production capacity is limited by the operating speed of the multi-thread leno device. If the multi-thread leno device is forced to operate at the higher loom operating speed, this results in premature wear of the machine components and therewith increased costs for maintenance, replacement and assembly. Furthermore, weaving faults are more likely.

As another disadvantage, the use of multi-thread cross leno devices often prevents the operation of an automatic removal and correction of weft faults such as weft breaks. If an automatic weft break removal is to be carried out, this requires the previously closed loom shed to be reopened and the weaving cycle of the loom to be operated in reverse. However, in such an operation, the catch selvage shed that has bound in the faulty weft thread is not always completely reopened, so that the faulty weft thread is not completely released from the catch selvage. For this reason, the weft fault removal or correction cannot be carried out with the desired efficiency.

Moreover, it is disadvantageous in the known arrangement, that the conventional cross leno devices produce the catch selvage strip in advance of the beat-up and binding point of the main loom shed, i.e. the beat-up edge of the woven web, in the direction of the catch selvage thread spool. It can be said that the cross leno devices pre-weave or pre-work the catch selvage strip ahead of the weaving of the fabric web. This is especially true on the weft thread arrival side of the loom shed, where the weft thread is subjected to a lower tension than at the weft thread insertion side.

Various further problems arise by using the two different kinds of devices or mechanisms for forming the fabric list or primary selvage on the one hand and the catch selvage on the other hand. As described above, rotating leno selvage devices, either with or without a reversible rotation of the leno rotor, are preferably used for high speed looms for forming very high quality woven web edges. On the other hand, for cost reasons and the like, the temporary catch selvage strips are formed using conventional leno arrangements and particularly multi-thread cross-leno devices, which are not suitable for use at high operating speeds due to the mechanical limitations thereof. As a result, the use of rotational leno devices for forming the fabric list, in combination with conventional catch selvage leno devices for forming the catch selvage, prevents the advantages of the rotational leno device from being fully achieved. Namely, while the high quality web edge is realized, the operating speed and therewith the output capacity of the loom are limited by the maximum operating speed of the mechanically operating catch selvage leno devices.

SUMMARY OF THE INVENTION

In view of the above, it is an object of the invention to provide a method for forming both a fabric list or primary selvage along the fabric edge as well as a catch selvage during the production of a woven web on a loom, and more specifically whereby the free ends of the weft threads may be securely bound in along both edges of the woven web and a high quality and durable fabric edge as well as a temporary catch selvage are simultaneously produced. It is a further object of the invention to provide an apparatus for carrying out the method, which makes it possible to minimize the amount of waste of both the weft threads and the catch selvage threads, and by which it is possible to avoid the use of complicated means for producing a conventional catch selvage strip. Still a further object of the invention is to achieve a catch selvage consisting, to the greatest possible extent, of a single or pure type of material, so as to enable the recycling or reprocessing of the catch selvage strip waste material. It is also an object of the invention to provide suitable means for carrying the inventive apparatus within a loom. The invention also aims to overcome or avoid the further problems of the prior art, and aims to achieve additional advantages, as apparent from the present description.

The above objects have been achieved in a method of producing a woven web having fabric list edges and at least one temporary catch selvage strip, according to the invention, including the following steps. A main loom shed is formed of main warp threads, a fabric list shed is formed of leno threads, and a catch selvage shed is formed of catch selvage threads. Then, at least one weft thread is inserted into the loom shed, the fabric list shed, and the catch selvage shed, and is beat-up against the beat-up edge of the woven web, of the fabric list, and of the catch selvage. Next, the beat-up weft thread is bound in by the warp threads, the leno threads, and the catch selvage threads, by closing the respective sheds. It is not necessary that each of the sheds be closed to bind in the respective weft thread in each weft insertion cycle. For example, the fabric list and/or the catch selvage may have a different binding pattern, e.g. a two-shot or three-shot binding pattern, as compared to the woven web, e.g. which may have a single-shot binding pattern. After the weft thread has been bound in, a weft thread cutter cuts the bound in weft thread from the remaining supply of the ready weft thread.

Especially according to the invention, both the fabric list and the catch selvage are respective full leno bound edges formed by rotation of respective rotating leno disks or rotors of first and second rotating leno selvage forming devices. The leno devices may be adapted to provide or not to provide a reversible rotation direction of the leno rotors. The two respective leno rotors respectively guide, carry and manipulate the leno threads or fabric list threads for forming the fabric lists and the catch selvage threads for forming the catch selvage.

The above objects have further been achieved in an apparatus according to the invention, for carrying out the above method. The present apparatus includes a first rotational leno device with a rotating leno disk or rotor for carrying, guiding and manipulating a leno thread for forming the fabric list, and a second rotational leno device with a rotating leno disk or rotor for carrying, guiding and manipulating a catch selvage thread for forming the catch selvage. The two leno rotors are adapted to be driven with a controlled rotation, either with or without a controlled reversal of the rotation direction, in order to bind in the weft threads with a full leno binding along both the fabric lists and the catch selvages.

In a particular embodiment, the two rotating leno devices are combined together to form a single modular structural unit in the form of a building block system, whereby this single structural unit can be carried in a spatially adjustable manner within a loom by a special carrier structure provided according to the invention. This carrier structure comprises at least one first structural component that is adapted to be rigidly secured to the loom frame and that is adjustable in at least one plane, a second component connected to the first component, and third component connected to the second component. The third component is arranged in a plane by itself so as to be pivotable about a vertical axis. The structural unit including the two leno devices is connected to the third component in such a manner that the structural unit is slidable along and swingable or pivotable about the central axis of the third component.

A primary feature of the invention is that a respective full rotation leno device is used for forming the secondary or catch selvage as well as the primary or fabric list selvage. Particularly, a leno device incorporating the full leno technology described in U.S. Pat. No. 5,518,039 or in U.S. Pat. No. 5,524,678, either with or without reversal of the rotation direction of the rotating leno rotor carrying the leno threads, can be used for both the catch selvage and the fabric list. Thus, according to the invention, the fabric list and the catch selvage are respectively formed along the outer edges of a woven web, as respective full leno binding edges by respective first and second rotational leno selvage devices having respective first leno rotors carrying the fabric list threads for the fabric list and carrying the catch selvage threads for the catch selvage. The leno rotors may rotate in a single direction, or may be reversibly rotatable.

Accordingly, the apparatus of the invention includes a first and a second rotating leno selvage forming device, respectively with or without a reversible rotating direction, for carrying the fabric list threads and the catch selvage threads. The invention also provides a carrier structure for carrying the apparatus including the two leno selvage forming devices, and for mounting the apparatus in a position adjustable manner within a loom.

The invention achieves the following advantages. First of all, the invention makes it possible to achieve and utilize all of the advantages of full rotation leno binding technology for producing both the permanent fabric list and the temporary catch selvage. In this manner, a high quality fabric list is produced, and the loom may be operated at full speed, without limitation by the slower or more cumbersome prior art technology for forming the temporary catch selvage.

Secondly, using the full rotation leno binding technology for forming the catch selvage makes it possible to achieve a pure-type waste, i.e. waste that does not include different types of thread materials therein. For example, with this technology, it is possible to use wool catch selvage threads when a woolen fabric is being woven, and to use synthetic catch selvage threads when a synthetic fabric is being woven, because the rotating leno devices are suitable for handling many different types of thread materials. This purity of the waste arising once the catch selvage is trimmed off of the fabric allows essentially all of the catch selvage waste to be practically recycled and reused, which achieves cost savings for the weaving mill or loom operator.

Furthermore, using the full rotation leno binding technology for the catch selvage strip avoids the conventional use of a rather large number of catch selvage thread spools. Thus, eight to twenty catch selvage threads and the associated spools can be avoided for each catch selvage strip that is to be formed. This simplifies and reduces the cost of the loom equipment.

Especially when the two rotational leno devices are combined or incorporated into a single modular structural unit in a compact arrangement, it is possible to save about 25 mm (approx. 1 inch) of weft material for each weft shot in gripper-type looms. This is achieved since the gripper can be positioned closer to the reed on the draw-out side of the shed, and the thread reaching and presenting devices as well as the weft thread cutter can be positioned closer to the reed on the insertion side, by an amount corresponding to the reduced width of the catch selvage strip. This reduction or savings on weft thread material achieves cost savings for the fabric manufacturer.

BRIEF DESCRIPTION OF THE DRAWINGS

In order that the invention may be clearly understood, it will now be described, in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
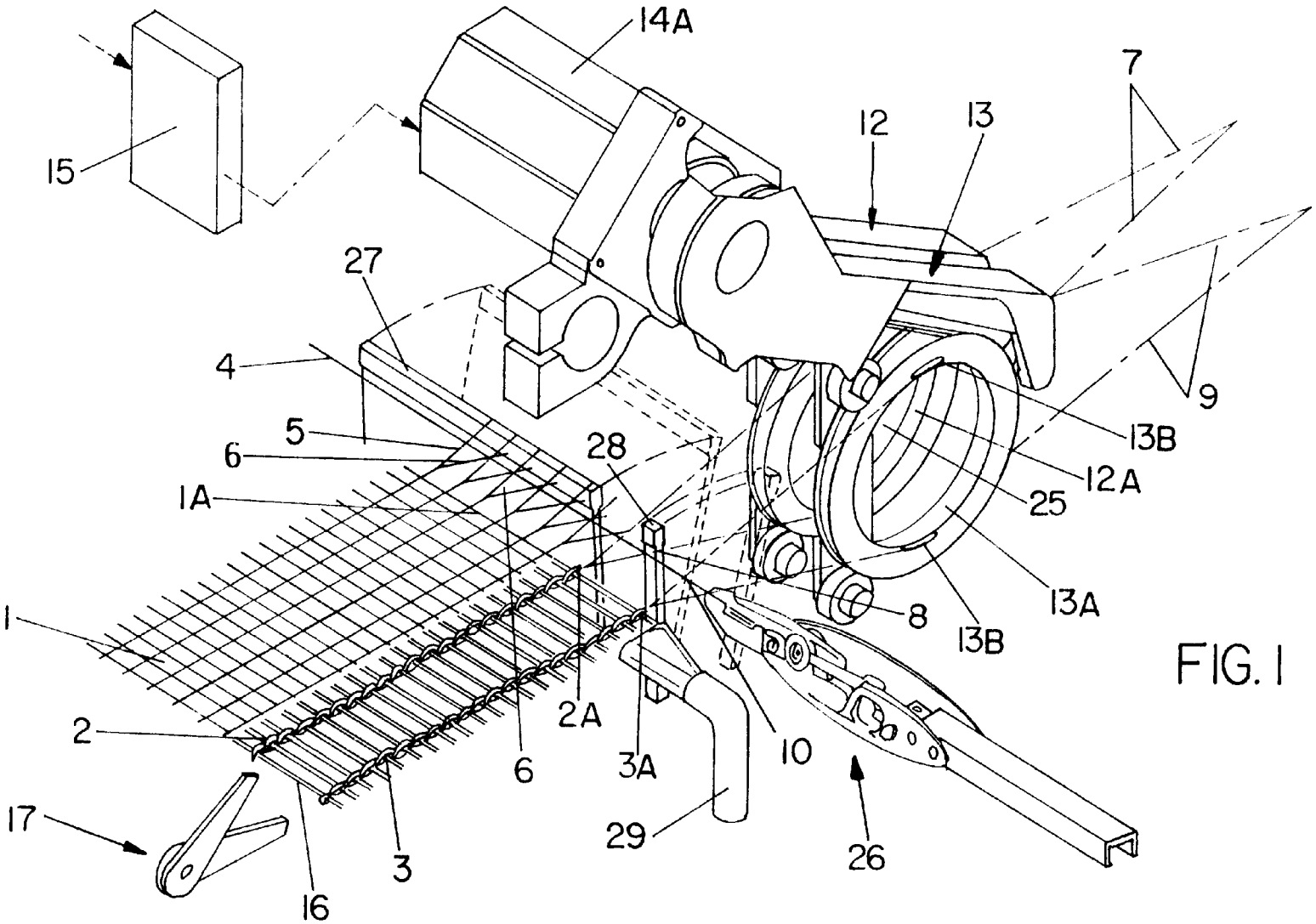
FIG. 1 is a schematic perspective view of an apparatus according to the invention including two rotational leno selvage forming devices with a common remote drive.

In the example embodiment of FIG. 1, the apparatus comprises a first rotational leno device 12 and a second rotational leno device 13. The construction, arrangement, and operation of these two leno devices is fully described in U.S. Pat. No. 5,524,678, the entirety of which has been incorporated herein. Thus, a redundant description of many of the details will be omitted here. The rotational leno selvage forming devices 12 and 13 respectively comprise a leno rotor 12A having thread guide eyelets 12B (not visible in FIG. 1) for receiving and guiding leno threads or fabric list threads 7, or a leno rotor 13A having thread guide eyelets 13B for receiving and guiding catch selvage threads 9. The two leno devices 12 and 13 are operatively connected to a rotary drive 14A, for example by means of drive belts or the like, and the rotary drive 14A is connected to a drive control 15 to receive control signals therefrom.

By carrying out a respective half-rotation about the central axis 25, the leno rotor 12A manipulates the leno threads 7 to form an open fabric list shed 8, and the leno rotor 13A manipulates the catch selvage threads 9 to form an open catch selvage shed 10, approximately synchronously with the formation of the main loom shed 6 by the warp threads 5. The particular means for forming the main loom shed 6 are not shown here, because they are generally known in the art, and any conventional means can be used in this context, and would be located generally to the upper right of FIG. 1 for example.

Once the open sheds 6, 8 and 10 are formed, at least one weft thread 4 is inserted into and through the sheds 6, 8 and 10 from the insertion side of the main loom shed 6 to the arrival, exit or drawing-out side, by means of pneumatic or mechanical weft insertion devices. The present example in FIG. 1 shows a mechanical weft insertion member 26, such as a rapier rod with a weft gripper mounted thereon. The weft thread 4 that has been inserted into the sheds 6, 8 and 10 in this manner, remains held or retained by the weft insertion member 26 at the shed exit side until the time at which the respective weft thread 4 is beat-up by the weaving reed 27 against the beat-up edge 1A of the woven web 1 and the beat-up edge 2A of the fabric edge list 2, and by the auxiliary reed 28 against the beat-up edge 3A of the catch selvage, and thereafter until the time that the weft thread 4 is bound in by closing the respective loom shed forming devices.

After the weft thread 4 is bound in, using a synchronous control, a new loom shed is opened by the respective loom shed forming devices, and a new respective fabric list shed and catch selvage shed is opened by respective half-rotation of the leno rotors 12A and 13A. Then, at least one new weft thread is inserted into the new open sheds. In this manner, a woven web 1 is produced, which has a primary selvage or fabric list 2, and spaced apart therefrom a catch selvage 3, along one or both side edges of the woven web 1. As will be described below, the catch selvage 3 is generally present only temporarily during the weaving process, because the catch selvage strip will be cut or trimmed off of the woven web when preparing the finished fabric.

Figure 5:
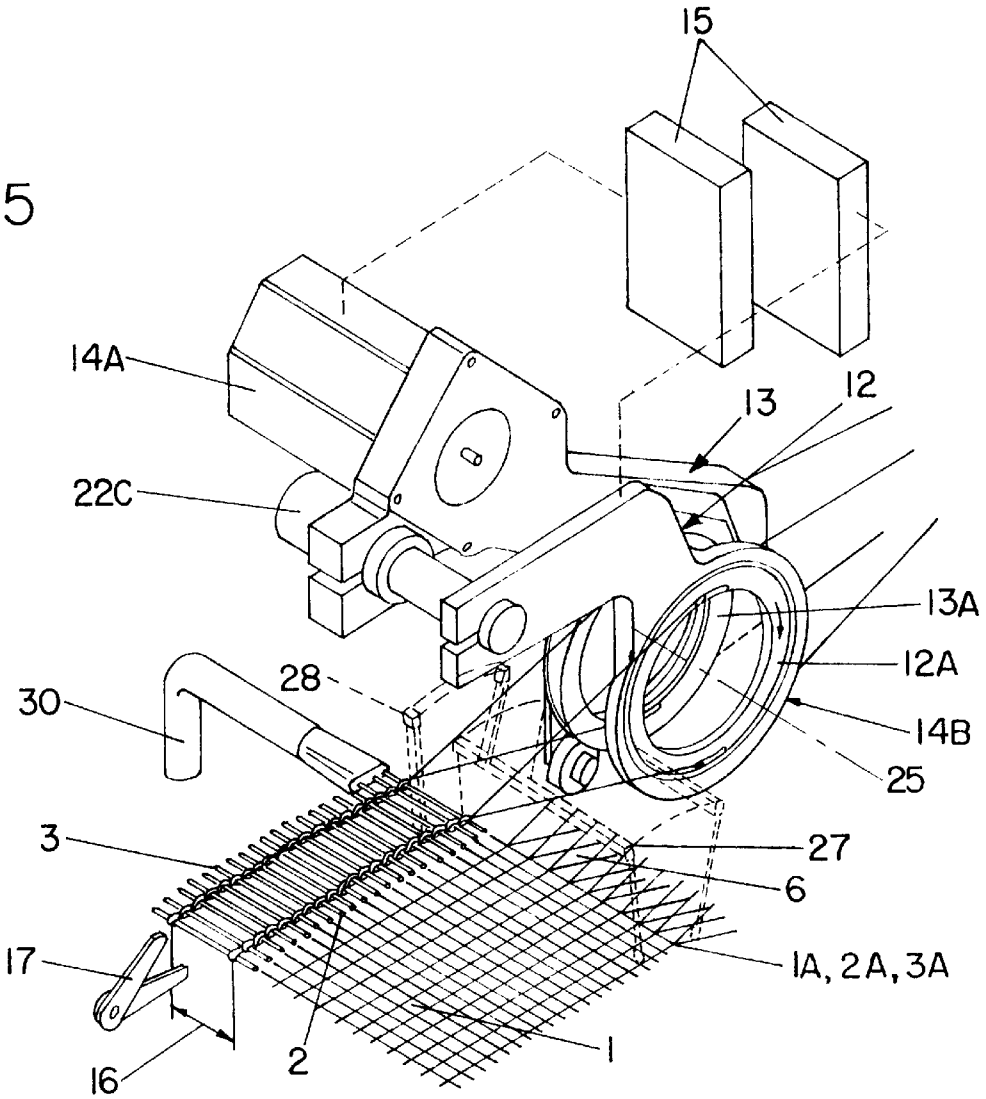
FIG. 5 is a schematic perspective view of another embodiment of the apparatus, including two rotational leno devices, wherein one of the leno devices includes a remote drive and the other leno device includes an integral drive.
Figures 6, 7, 8:
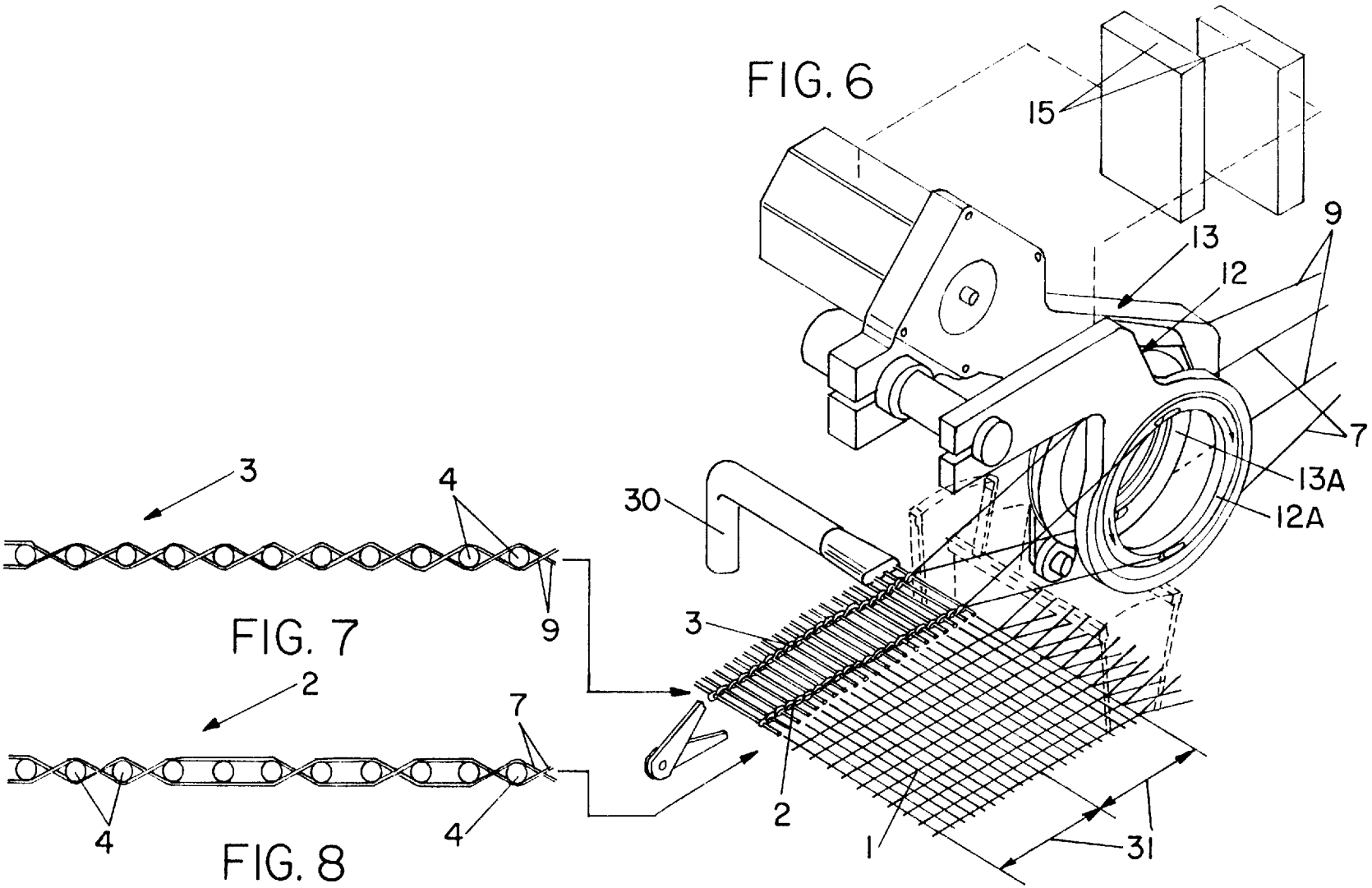
FIG. 6 is a schematic perspective view of the apparatus according to FIG. 5, illustrating an example in which the leno rotors of the leno devices carry out their rotation, and a reversal of the rotation direction, independently of one another.
FIG. 7 is a detail sectional view of an example binding pattern used for the insertion-side catch selvage in the example shown in FIG. 6.
FIG. 8 is a detail sectional view of an example binding pattern used for the insertion-side fabric list with skips in the binding pattern.

It is significant according to the invention that both the fabric list 2 and the catch selvage 3 are respectively formed as firmly fixed or bound-in full leno bindings, by the operation of the two leno rotors 12A and 13A carrying out a plurality of successive half-rotations in one rotation direction, preferably followed by the same number of successive half-rotations in the opposite rotation direction. Since both rotational leno devices 12 and 13 are driven by a common rotary drive 14A, it is ensured that the two leno rotors 12A and 13A operate in synchronism with each other. It is preferably further ensured that the weft threads 4 are bound-in by the operation of the leno rotors 12A and 13A synchronously with binding-in of the weft threads 4 by the main loom shed forming devices of the loom. The illustrated apparatus is installed at the right side of a loom, for example at the weft exit side, while it should be understood that another apparatus of the same construction is arranged at the left side of the loom, i.e. the weft insertion side, as is shown in FIGS. 5 and 6 for example. Particularly, as schematically shown in the drawings, the apparatuses are arranged next to or alongside of the front main shed 6 formed by the warp threads 5, and thus in front of the main shedding means which are not shown.

In order to be able to direct the free ends of the weft threads 4 in the catch selvage to a fabric spreader or expander (not shown) in an orderly manner, a thread holder or stretching device 29 and 30 is respectively arranged on both sides of the woven web 1. This weft thread holder or stretcher device 29 and 30 may have any known conventional construction and operation, such as a pneumatic suction and/or mechanical clamping, for engaging and tensioning the ends of the weft threads 4. Since the two rotational leno devices 12 and 13 are arranged coaxially side-by-side, a weaving gap providing a cutting path 16 is formed between the fabric list 2 and the catch selvage 3, as is especially shown also in FIG. 5. Preferably, the cutting path 16 is just wide enough to accommodate a cutting or trimming device 17 that cuts the weft threads along the cutting path 16 in order to trim the catch selvage strip from the woven web 1 at the appropriate time. For example, the cutting path 16 has a width in the range of about 10 mm to about 25 mm, which is achievable by the compact arrangement of the two leno devices 12 and 13.

Figures 2, 2A:
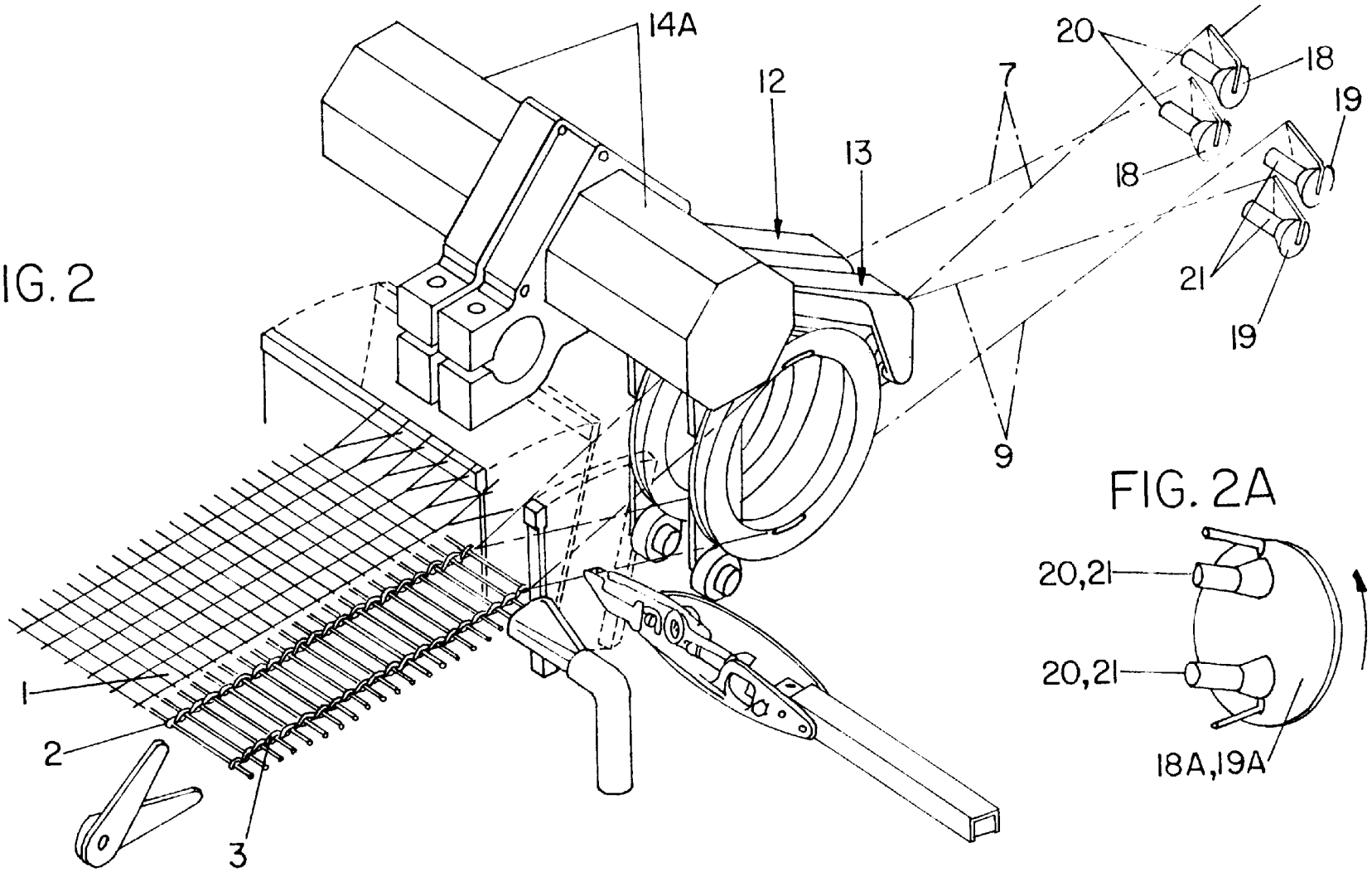
FIG. 2 is a schematic perspective view similar to that of FIG. 1, but showing an apparatus having two separate remote drives for the two rotational leno devices.
FIG. 2A is a schematic perspective view of a rotatably driven spool holder.

FIG. 2 shows an alternative embodiment in which each one of the rotational leno devices 12 and 13 is equipped with its own independent rotary drive 14A. In this embodiment, it is possible to control and operate each rotational leno device 12 and 13 individually and separately, especially with regard to the reversal of the rotation direction and with regard to the precise time for binding-in the weft threads for forming the exit-side catch selvage 3 relative to the fabric list 2 and the main woven web 1.

The catch selvage threads 9 for forming the catch selvage 3 are stored on and pulled from spools 21 mounted on spool holders 19, while the leno threads or fabric list threads 7 for forming the fabric list 2 are stored on and pulled from thread supply spools 20 mounted on spool holders 18. In each embodiment using reversing rotation directions of the leno rotors, the spool holders 18 and 19 may be rigidly and immovably mounted on the loom. On the other hand, in a case in which the leno rotors 12A and 13A are to be driven in a single rotation direction without rotation reversal, then the spools 20 and 21 are arranged on respectively rotatably driven spool holders 18A and 19A (see FIG. 2A) having any known construction. Such a rotatably driven spool holder is necessary in order to match the rotation of the leno rotors 12A and 13A. Otherwise, the consistent rotation of the leno rotors 12A and 13A in a constant rotation direction would respectively twist together the fabric list threads 7 on the one hand, and the catch selvage threads 9 on the other hand, in the back shed of the leno devices, i.e. in the thread supply path between the spools 20 and 21 and the leno rotors 12A and 13A respectively. In the alternative embodiment, the reversing rotation of the leno rotors 12A and 13A avoids twisting of the threads in the back sheds, and thus avoids the need of a rotatable thread supply.

Figures 3, 4:
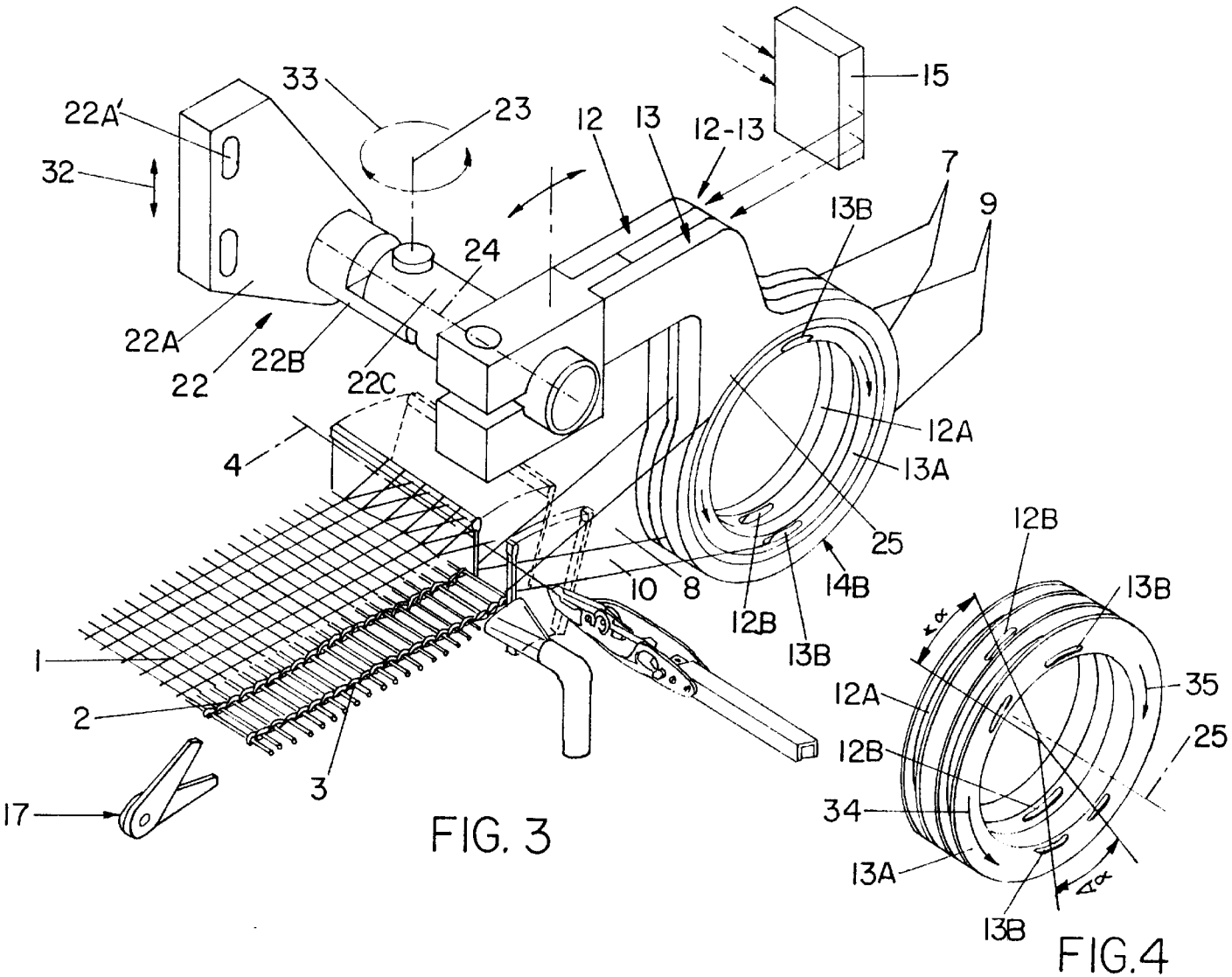
FIG. 3 is a schematic perspective view similar to that of FIG. 1, but showing still another embodiment in which the two rotational leno devices each respectively include a separate integral drive, and wherein the apparatus is mounted on a position-adjustable carrier structure.
FIG. 4 is a detail view of the leno rotors, respectively embodied as annular disks or rings, of the rotational leno devices in the embodiment of FIG. 3, wherein the two leno rotors have respective thread guide eyelets rotationally offset from one another.

FIG. 3 shows another variation in which the apparatus comprises first and second rotational leno devices 12 and 13 having a construction, arrangement and manner of operation as fully described in U.S. Pat. No. 5,518,039, the entirety of which has been incorporated herein by reference. A redundant description of many details will be omitted here. A significant feature in this embodiment is that both leno rotors 12A and 13A themselves are respectively directly embodied as the rotors of a position-adjustable electro-motor 14B such as a servo motor or position stepper motor drive. This achieves a very compact arrangement. The formation of the fabric list shed and the catch selvage shed is generally carried out analogously as described above in connection with the embodiment according to FIG. 2. Via the drive control 15, each one of the leno devices 12 and 13 is individually and separately controllable and actuatable, in correspondence with the formation of the loom shed.

Moreover, the two leno devices 12 and 13 in this embodiment are incorporated together to form a single integral modular structural unit 12–13 that is mounted and received on a carrier structure 22. The carrier structure 22 as a whole is mounted to the loom via elongated or oblong holes 22A' and corresponding machine elements such as bolts, in such a manner that the carrier structure 22 as a whole is position adjustable in the vertical direction 32. More particularly, a first structural component 22A of the carrier structure 22 forms a mounting bracket or mounting base including the elongated holes 22A'. At least a second structural component 22B and a third structural component 22C are connected to the first structural component 22A. The third structural component 22C is connected to the second structural component 22B in such a manner that the third component 22C alone is pivotable or swingable in a plane in the direction of double arrow 33 about a vertical pivot axis 23. Moreover, the structural unit 12–13 including the integrated leno devices 12 and 13 is connected to the third component 22C in such a manner that the structural unit 12–13 is slidable along and tiltable about the central axis 24 of the third component 22C. The resulting tilting or pivoting ability of the structural unit 12–13 is especially advantageous in the case of weaving with excessively widely beamed warps. In this embodiment, the fabric list threads 7 and the catch selvage threads 9 are pulled off of thread supply spools in the same manner as described above in connection with FIG. 2.

FIG. 4 is a detail view showing two leno rotors 12A and 13A that are both rotatable about a central axis 25 and that respectively have thread guide eyelets 12B and 13B, for respectively receiving the fabric list threads 7 and the catch selvage threads 9. The leno rotors 12A and 12B may be particularly embodied and adapted for use in the apparatus shown in FIG. 2 or the apparatus shown in FIG. 3. The rotors 12A and 12B are each rotatable in a forward rotation direction 34 as well as a reverse rotation direction 35. The rotation axis 25 is preferably substantially parallel to the fabric beat-up edge, whereby "substantially" means within the normal assembly and operating tolerances.

According to a significant feature of the invention, the particular time point for binding-in the weft threads in the catch selvage 3 does not coincide with the time point for binding in the weft threads in the fabric list 2. More specifically, the catch selvage shed 10 binds-in the weft thread 4 at a rotational lead angle $\Delta\alpha$ of several degrees before the fabric list shed 8. In other words, the rotation of the leno rotors 12B and 13B is so controlled, that the rotation of the leno rotor 13B is always ahead of or in advance of the rotation of the leno rotor 12B by the lead angle $\Delta\alpha$, both in the forward rotation direction 34 as well as in the reverse rotation direction 35 after a direction reversal. The amount or extent of the leading rotation, i.e. the magnitude of the lead angle $\Delta\alpha$, is freely programmable in the drive control 15, but is preferably in the range of several degrees or particularly in the range from 5° to 35°. By binding the weft thread 4 into the catch selvage 3 first, i.e. before the fabric list 2, it is ensured that the catch selvage 3 holds the end of the weft thread 4 and prevents the spring-back of the weft thread 4 or the shrinking deformation of the fabric list 2.

FIG. 5 shows an embodiment of an apparatus according to the invention arranged at the insertion side of the loom shed 6, wherein the apparatus includes two different drive arrangements 14A and 14B. A leno device 13 having an integral drive 14B is provided for forming the fabric list 2, i.e. the leno rotor 13A is itself the rotor of a position-adjustable electric motor such as a servo-motor or stepper-motor, while the leno device 12 is connected to a remote drive motor 14A for driving the leno rotor 12A for forming the catch selvage 3. The two drives 14A and 14B are controlled by a drive control 15. At the insertion side of the loom shed 6, analogously as at the weft exit or drawing-out side of the loom shed as described above, the ends of the bound-in weft threads 4 are held by a thread holder device 30 until the time at which these thread ends are taken up in the fabric spreader or expander arrangement, which is not shown. Preferably, the thread holder device 30 is a pneumatic suction device that holds the threads under the appropriate tension.

FIG. 6 shows an embodiment of an apparatus as has been described in connection with FIG. 5, in a particular example of carrying out the method according to the invention for forming a fabric list 2 and a catch selvage 3. In this example, the ratio of the number of rotation direction reversals of the leno rotor 13A or of the leno rotor 12A per woven web section 31 is not equal to one, wherein each web section 31 is defined by a prescribed number of weft shots. In other words, more or fewer than one respective reversal of the rotation direction of the leno rotors 12A and 13A may be carried out during the weaving of each web section 31, but a reversal is not carried out after each weft thread insertion. Instead, in order to produce a high quality fabric list on a woven fabric for use in the clothing industry, it is advantageous if the reversal of the rotation direction of the leno rotors is only carried out after producing more than twenty full rotation leno bindings, for example. On the other hand, for convenience, simplicity, and best functionality, the temporary catch selvage 3 can be formed with successive sets of fewer than ten full rotation leno bindings followed by a reversal of the rotation direction of the leno rotor 13A. Thereby, the finished fabric list has a visually pleasant appearance and a high-quality appearance, while the temporary catch selvage 3 has a comparatively higher weft density than that which can be achieved using any conventional leno system. Thus, an important feature of the invention is that the ratio of the rotation direction reversals of an apparatus including two rotation leno devices 12 and 13 for forming a fabric list 2 and a catch selvage 3 is variable to any desired ratio, and particularly that this variation is freely selectable and programmable. Moreover, the ratio of reversals of the leno rotor 12A relative to the leno rotor 13A is also freely variable.

FIGS. 7 and 8 show an example of variable rotation direction reversal ratios and variable binding patterns resulting from a "skip" in the rotation and binding-in carried out by one or both of the leno rotors. FIG. 7 shows the catch selvage threads 9 that form the catch selvage 3 by means of rotation of the leno rotor 13A in one direction, in order to firmly secure the free ends of the weft threads 4 by means of full rotation leno binding, in which each weft thread 4 is individually bound in by a respective half-rotation shedding of the catch selvage threads 9. Such a binding pattern can also be used for the fabric list 2 formed by the leno threads 7. The rotation of the leno rotors 12A and 13A may be reversed after any desired and pre-programmed number of half-rotations to then subsequently carry out a corresponding number of half-rotations in the opposite direction. The points of rotation reversal are not plainly visually detectable in either the catch selvage 3 or the fabric list 2. For this reason, the merely schematic illustration of FIG. 7 does not show where a reversal of rotation direction has occurred.

FIG. 8 shows an example of the leno threads or fabric list threads 7 that form a fabric list 2 by means of rotation of the leno rotor 12A in one direction, so as to bind-in the ends of the weft threads 4 by means of full rotation leno binding. As shown in this example of FIG. 8, various binding patterns for the weft threads 4 are achievable, such as so-called binding skips, or two-shot or three-shot bindings, whereby two or three weft threads are inserted before a shed reversal and binding-in of the weft threads takes place. In any event, the rotation and the rotation reversal of the two leno devices 12 and 13 are freely programmable to achieve any desired binding-in pattern and any desired rotation reversal sequence, which may be independently or consistently selected for either or both of the fabric list 2 and the catch selvage 3.

In general, according to the invention, the technology and equipment that was previously known for use in forming the leno fabric list 2 is now also used without limitations for producing a temporary catch selvage 3 in addition to the permanent fabric list 2. Moreover, in the combination of two rotational leno devices into a single integrated structural unit, it is possible to achieve material savings in the amount of thread needed for forming the catch selvage as well as the amount of thread needed for each weft thread. The savings in the weft material are achieved, especially in gripper-type looms, since the thread reaching assembly and the weft cutter can be moved closer to the loom reed 27 by an amount corresponding to the reduced width relative to a conventionally produced catch selvage strip. More particularly, the present leno catch selvage preferably comprises only two binding threads along a single binding edge, and thus avoids the conventional wide catch selvage strip comprising eight to twenty selvage binding threads. Thereby it is also possible to move the starting position of the weft thread insertion members, namely both the bringer gripper and the receiver gripper, closer to the reed 27.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of producing a woven web having a fabric list along an edge of said woven web and a catch selvage at least temporarily adjacent and along said fabric list in a loom, comprising the following steps:

a) forming a front main shed of warp threads;

b) forming a fabric list shed of fabric list threads;

c) forming a catch selvage shed of catch selvage threads;

d) inserting at least one weft thread into said main shed, said fabric list shed and said catch selvage shed;

e) beating up said at least one weft thread against a beat-up edge of said woven web, said fabric list and said catch selvage;

f) binding in said at least one weft thread with said warp threads by closing said main shed, to form said woven web;

g) binding in said at least one weft thread with said fabric list threads by closing said fabric list shed, to form said fabric list;

h) binding in said at least one weft thread with said catch selvage threads by closing said catch selvage shed, to form said catch selvage; and i) respectively repeating said steps a) to h);

wherein said loom includes a first rotational leno device having a first leno rotor guidingly receiving said fabric list threads, and a second rotational leno device having a second leno rotor guidingly receiving said catch selvage threads;

wherein said steps of forming said fabric list shed and closing said fabric list shed respectively comprise rotating said first leno rotor of said first rotational leno device;

wherein said steps of forming said catch selvage shed and closing said catch selvage shed respectively comprise rotating said second leno rotor of said second rotational leno device; and wherein said rotating of said first leno rotor and said rotating of said second leno rotor comprise a rotation operation selected from the group consisting of:

a first rotation operation comprising rotating said first leno rotor in a first forward rotation direction and subsequently rotating said first leno rotor in a first reverse rotation direction opposite said first forward rotation direction during said repeating of said steps a) to h), and rotating said second leno rotor in a second forward rotation direction and subsequently rotating said second leno rotor in a second reverse rotation direction opposite said second forward rotation direction during said repeating of said steps a) to h); and a second rotation operation comprising rotating said first leno rotor in a first single consistent rotation direction without reversal while rotating a first spool holder that holds two first supply spools supplying said fabric list threads to said first leno rotor, and rotating said second leno rotor in a second single consistent rotation direction without reversal while rotating a second spool holder that holds two second supply spools supplying said catch selvage threads to said second leno rotor.

2. The method according to claim 1, wherein said first and second rotational leno devices are arranged at a side of said front main shed, and wherein said steps of forming and closing said fabric list shed are carried out at said side of said front main shed by said first rotational leno device and said steps of forming and closing said catch selvage shed are carried out at said side of said front main shed by said second rotational leno device.

3. The method according to claim 2, wherein said rotating of said first leno rotor and of said second leno rotor comprises said first rotation operation.

4. The method of claim 3, further comprising switching from said rotating of said first leno rotor in said first forward rotation direction to said rotating of said first leno rotor in said first reverse rotation direction after a first specified number of rotations of said first leno device in said first forward rotation direction, and switching from said rotating of said second leno rotor in said second forward rotation direction to said rotating of said second leno rotor in said second reverse rotation direction after a second specified number of rotations of said second leno device in said second forward rotation direction.

5. The method according to claim 4, wherein said first specified number is not equal to said second specified number.

6. The method according to claim 3, wherein said step of closing said catch selvage shed is carried out before said step of closing said fabric list shed by carrying out said rotating of said second leno rotor at a rotational lead angle $\Delta\alpha$ ahead of said rotating of said first leno rotor, and wherein said rotational lead angle $\Delta\alpha$ is maintained during rotation of said first leno rotor in said first forward rotation direction and in said first reverse rotation direction and during rotation of said second leno rotor in said second forward rotation direction and in said second reverse rotation direction.

7. The method according to claim 6, wherein said fabric list and said catch selvage are formed on a weft thread exit side of said woven web, and said first and second rotational leno devices are arranged at said weft thread exit side.

8. The method according to claim 6, wherein said rotational lead angle $\Delta\alpha$ is in a range from 5° to 35°.

9. The method according to claim 2, wherein said step of closing said catch selvage shed is carried out before said step of closing said fabric list shed by carrying out said rotating of said second leno rotor at a relative rotational lead angle $\Delta\alpha$ ahead of said rotating of said first leno rotor.

10. The method according to claim 9, wherein said rotational lead angle $\Delta\alpha$ is in a range from 5° to 35°.

11. The method according to claim 2, wherein said rotating of said first leno rotor and of said second leno rotor comprises said second rotation operation.

12. The method according to claim 11, wherein said loom further includes at least one leno device controller adapted to be freely programmed to control an actuation of rotation of said first and second leno rotors, and wherein said steps of rotating said first and second leno rotors further comprise controlling an actuation of rotation of said first and second leno rotors by sending control signals from said at least one leno device controller to said first and second leno devices.

13. The method according to claim 2, wherein said rotating of said first and second leno rotors comprises rotationally driving said first and second leno rotors independently of one another.

14. The method according to claim 2, wherein said rotating of said first and second leno rotors comprises rotationally driving said first and second leno rotors in common and together with one another.

15. The method according to claim 2, wherein said step of forming said fabric list shed and said step of forming said catch selvage shed are carried out simultaneously.

16. The method according to claim 2, wherein said step of forming said main shed, said step of forming said fabric list shed and said step of forming said catch selvage shed are all carried out simultaneously.

17. The method according to claim 2, wherein said loom further includes a main loom drive, and said steps of rotating said first and second leno rotors comprise rotationally driving and controlling said first and second leno rotors independently of said main loom drive.

18. The method according to claim 2, wherein said loom further includes at least one leno device controller adapted to be freely programmed to control an actuation and reversal of rotation of said first and second leno rotors, and wherein said steps of rotating said first and second leno rotors comprise controlling an actuation and reversal of rotation of said first and second leno rotors by sending control signals from said at least one leno device controller to said first and second leno devices.

19. The method according to claim 2, wherein said catch selvage is a temporary catch selvage, and further comprising a step of cutting said at least one weft thread between said fabric list and said catch selvage after said step h), so as to remove said catch selvage from said woven web while said fabric list remains along said edge of said woven web.

20. The method according to claim 2, wherein said step c) comprises forming said catch selvage shed with a total of only two of said catch selvage threads and said step h) comprises forming said catch selvage with said two catch selvage threads.

21. The method of claim 2, being carried out using the same thread material respectively for said catch selvage threads and said at least one weft thread.

22. The method of claim 2, wherein different numbers of said at least one weft thread are inserted during different repetitions of said step d), so as to form a varying binding pattern of said at least one weft thread.

23. The method of claim 2, further comprising carrying out a different number of repetitions of said steps a) and f) as compared to at least one of said steps b) and g) and said steps c) and h), so as to form a different binding pattern in said woven web as compared to at least one of said fabric list and said catch selvage.

24. The method of claim 23, further comprising carrying out a different number of repetitions of said steps b) and g) as compared to said steps c) and h), so as to form a different binding pattern in said fabric list as compared to said catch selvage.

25. In a loom, an improved apparatus for producing a fabric list along an edge of a woven web and a catch selvage at least temporarily adjacent and along said fabric list, said improved apparatus comprising:

a first rotational leno device including a first leno rotor having at least one first thread guide adapted to guidingly receive fabric list threads for forming said fabric list, a second rotational leno device that is arranged adjacent said first rotational leno device and that includes a second leno rotor having at least one second thread guide adapted to guidingly receive catch selvage threads for forming said catch selvage, at least one leno device controller connected for control signal transmission to said first and second rotational leno devices, and adapted to control respective rotation of said first and second leno rotors, at least two first supply spools that store and supply said fabric list threads, and at least two second supply spools that store and supply said catch selvage threads, wherein said first and second rotational leno devices and said at least one leno device controller are respectively embodied according to an embodiment selected from the group consisting of:

a first embodiment wherein said first and second leno rotors are respectively adapted to rotate selectively in a forward rotation direction and in a reverse rotation direction opposite said forward rotation direction, and wherein said at least one leno device controller is further adapted to control a reversal of said rotation of said first and second leno rotors, and a second embodiment wherein said first and second rotational leno devices and said at least one leno device controller are respectively adapted so that said leno rotors respectively rotate in only one rotation direction without reversal, and said apparatus further comprises a rotatably driven first spool holder on which said at least two first supply spools are mounted and a rotatably driven second spool holder on which said at least two second supply spools are mounted.

26. The apparatus according to claim 25, wherein said first and second rotational leno devices are arranged at a side of a front main shed formed in said loom.

27. The apparatus according to claim 26, wherein said first and second rotational leno devices and said at least one leno device controller are respectively embodied according to said first embodiment.

28. The apparatus according to claim 27, wherein said at least one leno device controller is further adapted to be freely programmable to control the number and the times of said reversal of rotation and the total number of rotations of each of said leno rotors carried out for a given number of weft insertions.

29. The apparatus according to claim 27, further comprising an immovable first spool holder on which said first supply spools are mounted, and an immovable second spool holder on which said second supply spools are mounted.

30. The apparatus according to claim 26, wherein said first and second rotational leno devices and said at least one leno device controller are respectively embodied according to said second embodiment.

31. The apparatus according to claim 30, wherein said at least one leno device controller is further adapted to be freely programmable to control the total number of rotations of each of said leno rotors carried out for a given number of weft insertions.

32. The apparatus according to claim 26, further comprising a single common rotational drive connected to both said first and second leno rotors.

33. The apparatus according to claim 26, wherein said first rotational leno device further comprises a first rotational drive connected to said first leno rotor, and said second rotational leno device further comprises a second rotational drive that is separate and independent from said first rotational drive and that is connected to said second leno rotor.

34. The apparatus according to claim 26, wherein said first and second thread guides respectively comprise first and second thread guide eyelets provided respectively in said first and second leno rotors.

35. The apparatus according to claim 26, wherein each one of said first and second leno rotors is a respective leno disk having a discoidal shape.

36. The apparatus according to claim 35, wherein each said respective leno disk is an annular ring-shaped disk.

37. The apparatus according to claim 26, wherein said first and second rotational leno devices respectively integrally comprise first and second position-controllable electric motors, and wherein said first and second leno rotors are respective motor rotors of said first and second position-controllable electric motors.

38. The apparatus according to claim 26, wherein one of said first and second rotational leno devices comprises an integral position-controllable electric motor and said leno rotor of said one of said leno devices is a motor rotor of said position-controllable electric motor, and wherein the other of said first and second rotational leno devices further comprises an electric motor located remotely from and connected for rotational drive transmission to said leno rotor of said other of said leno devices.

39. The apparatus according to claim 26, wherein said first and second leno rotors are adapted to be rotated mutually independently of each other.

40. The apparatus according to claim 26, further comprising a cutting device, wherein said first and second leno rotors are laterally spaced apart from each other by a spacing distance to form a cutting path gap between said fabric list and said catch selvage just sufficient to accommodate said cutting device, and wherein said cutting device is arranged in said cutting path gap downstream of said leno devices in a web advance direction so as to cut weft threads of said woven web between said fabric list and said catch selvage.

41. The apparatus according to claim 26, wherein said first and second rotational leno devices are integrated together to form a single modular structural unit.

42. The apparatus according to claim 41, further comprising an adjustable carrier structure to which said structural unit is connected, wherein said carrier structure mounts said structural unit in said loom in a position-adjustable manner.

43. The apparatus according to claim 42, wherein said carrier structure comprises a first structural component that is selectively fixedly mounted on said loom in a manner that is position adjustable in at least one first plane, a second structural component connected to said first structural component, and a third structural component connected to said second structural component so as to be pivotable about a vertical axis in a single plane, wherein said structural unit is connected to said third structural component in such a manner that said structural unit is selectively and fixably slideable along and pivotable about a central axis of said third structural component.

44. The apparatus according to claim 43, wherein said first and second leno devices are so arranged in said structural unit and said structural unit is so connected to said third structural component that said first and second leno rotors are both rotatable about a common rotation axis.

45. The apparatus according to claim 44, wherein said common rotation axis is substantially parallel to a beat-up edge of said woven web, said fabric list and said catch selvage when said structural unit is in an operating position.

46. The apparatus according to claim 26, wherein said first and second rotational leno devices are arranged with said first and second leno rotors adjacent, parallel and coaxial relative to each other.

* * * * *